US005865013A

United States Patent [19]

Jackson

[11] Patent Number: 5,865,013

[45] Date of Patent: Feb. 2, 1999

[54] COMBINATION PACKAGE FOR A HAT AND GARMENT

[75] Inventor: Rodney Jackson, Westminster, Colo.

[73] Assignee: Imperial Headwear, Inc., Denver, Colo.

[21] Appl. No.: 869,839

[22] Filed: Jun. 5, 1997

[51] Int. Cl.[6] ..... B65B 11/50; B65B 25/20; B65D 85/00

[52] U.S. Cl. ..... 53/474; 206/8; 206/278; 206/471

[58] Field of Search ..... 53/474, 238, 237, 53/155; 206/8, 278, 457, 461, 471, 470; 229/87.15, 922

[56] References Cited

U.S. PATENT DOCUMENTS

| | | | |
|---|---|---|---|
| D. 378,732 | 4/1997 | Lawson | D9/320 |
| 2,740,567 | 4/1956 | Kaufman | 206/8 X |
| 4,091,927 | 5/1978 | Lunsford | 206/459 |
| 4,881,637 | 11/1989 | Peters et al. | 206/8 X |
| 5,012,531 | 5/1991 | Schoonover | 206/8 X |
| 5,022,515 | 6/1991 | Agostine | 206/8 |
| 5,316,139 | 5/1994 | Judd et al. | 206/278 |
| 5,344,003 | 9/1994 | Park | 206/8 |
| 5,407,066 | 4/1995 | Grange | 206/471 X |
| 5,485,919 | 1/1996 | Samberg et al. | 206/461 |

*Primary Examiner*—James F. Coan
*Attorney, Agent, or Firm*—Sheridan Ross P.C.

[57] ABSTRACT

A package for a combination of a hat and garment is disclosed, wherein the package supports a contour of the hat as it would appear when worn by a user, and additionally, the package is configured so that the hat and garment remain in their desired displayable positions and orientations substantially regardless of how the package is handled under normal retail sales handling conditions. In particular, the package of the present invention can be made of molded plastic that is reinforced by various walls and contours to inhibit denting and folding of the package and thereby prevents inappropriate deformation of the hat and garment therein. More particularly, the package is reinforced to prevent the folding or creasing of the brim of the hat, wherein such reinforcements also maintain the brim in a predetermined desirable position.

21 Claims, 3 Drawing Sheets

COMBINATION PACKAGE FOR A HAT AND GARMENT

FIELD OF THE INVENTION

The present invention relates to a package for containing both a hat and a garment; and more particularly, for retaining these items wherein the integrity of a contour of the hat and a related brim is reinforced by the packaging.

BACKGROUND OF THE INVENTION

Various types of packages for clothing and related articles are known. In many cases, packages containing clothing have the shape of a box. In most cases, a box configuration is satisfactory in that the clothing and any related items can be folded appropriately so that when viewed through any transparent portions of the box, the items therein appear to be neatly folded and orderly packaged. However, such simple packaging becomes less advantageous when the items enclosed therein are desired to be displayed in ways where the shapes or contours of the items are sufficiently different so that an enclosing package having a simple box shape would be inordinately large and consequently likely to have a large internal unfilled volume. Accordingly, to position items in such an interior volume so that they are attractively displayed and remain in place becomes difficult.

The above notions are particularly pronounced with combinations of items such as, for example, a hat and a shirt, wherein it is desired that the hat be displayed in a manner similar to how it would be worn. That is, it would be desirable to provide a package that provided support for maintaining the contour of a hat and at the same time also provide an area for a shirt so that both are attractively displayed and remain in their desired display positions through various types of handling and shipping.

SUMMARY OF THE INVENTION

The present invention is a package for containing a combination of a hat and a garment or other promotional items (e.g., a shirt, jacket, sweater, golf tee(s), golf ball(s) etc.) wherein the hat is displayed so that a contour of the hat as it would be on a wearer is provided, and the garment is displayed so that a substantial portion of the front of the garment is visible. Moreover, the package of the present invention includes mating top and bottom package portions, wherein at least the top portion includes transparent areas for viewing both the hat and the garment.

The package of the present invention further includes walls and internal package area separators for reinforcing the package and thereby assisting in maintaining the integrity of the package so that it cannot be easily folded or creased. Further, it is a particular aspect of the present invention that a brim of the included hat is reinforced by the package against being bent or creased accidentally due to, for example, a folding or denting of the package. In particular, the separators referred to hereinabove are provided between a hat retaining portion and a garment retaining portion of the package, wherein at least a portion of the hat brim is positioned therebetween for protecting the brim from being damaged.

It is also an aspect of the present invention that the top and bottom portions of the package mate in a manner so that when assembled, these two portions can be stapled, glued and/or heat sealed.

It is also an aspect of the present invention that, in one embodiment, both the top and bottom portions are each made of molded plastic. Further, in some embodiments, the top and bottom portions can be molded as a single piece of plastic that is assembled to form the package of the present invention by folding the top and bottom portions together along a plastic hinge.

Other features and benefits of the present invention will become apparent from the detailed description hereinbelow and the accompanying figures contained herein.

DETAILED DESCRIPTION

Figure 1:
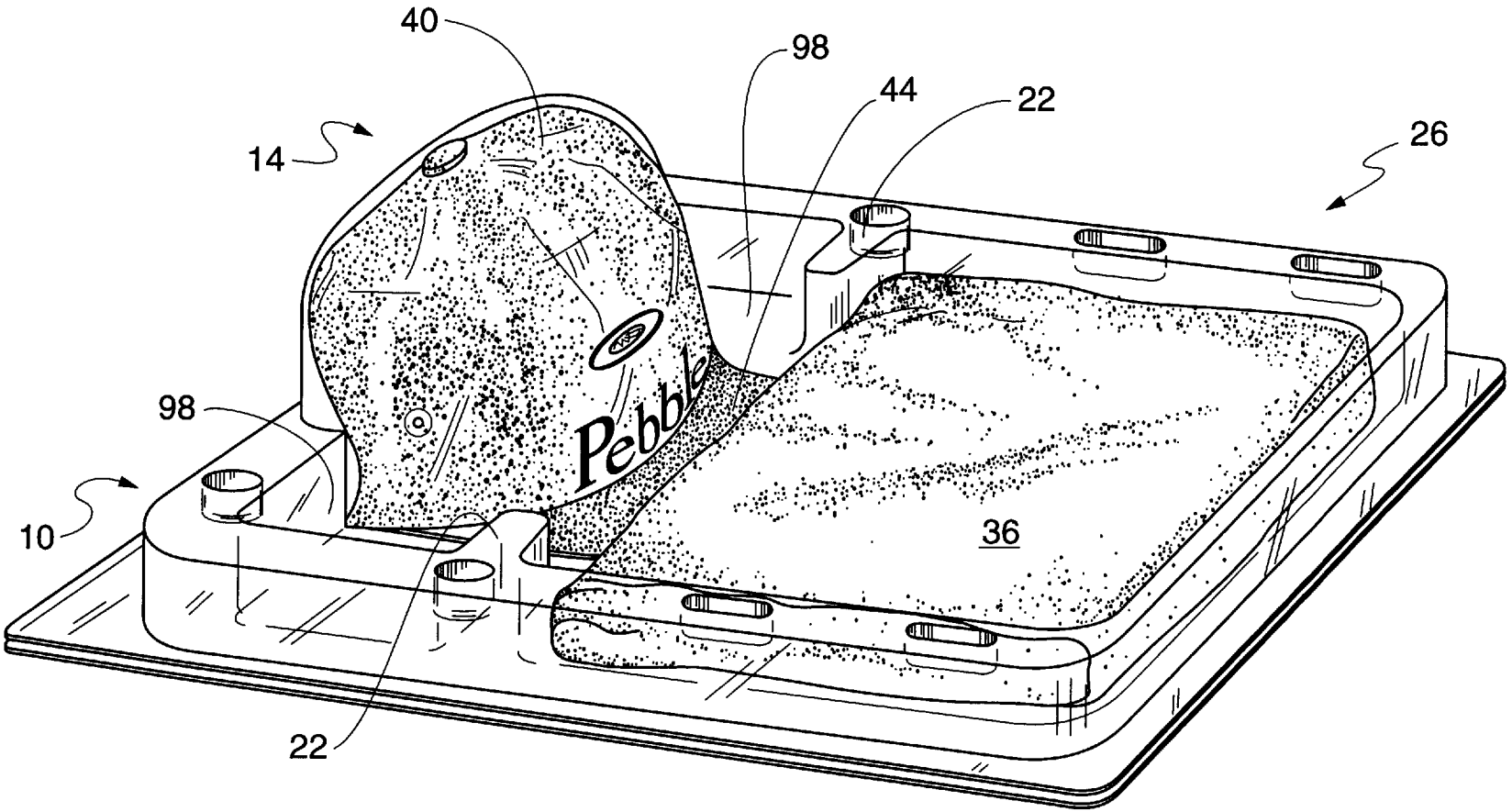
FIG. 1 is a perspective view of the package 10 of the present invention, wherein the top portion of the package that is typically presented to a customer is primarily shown.
Figure 2:
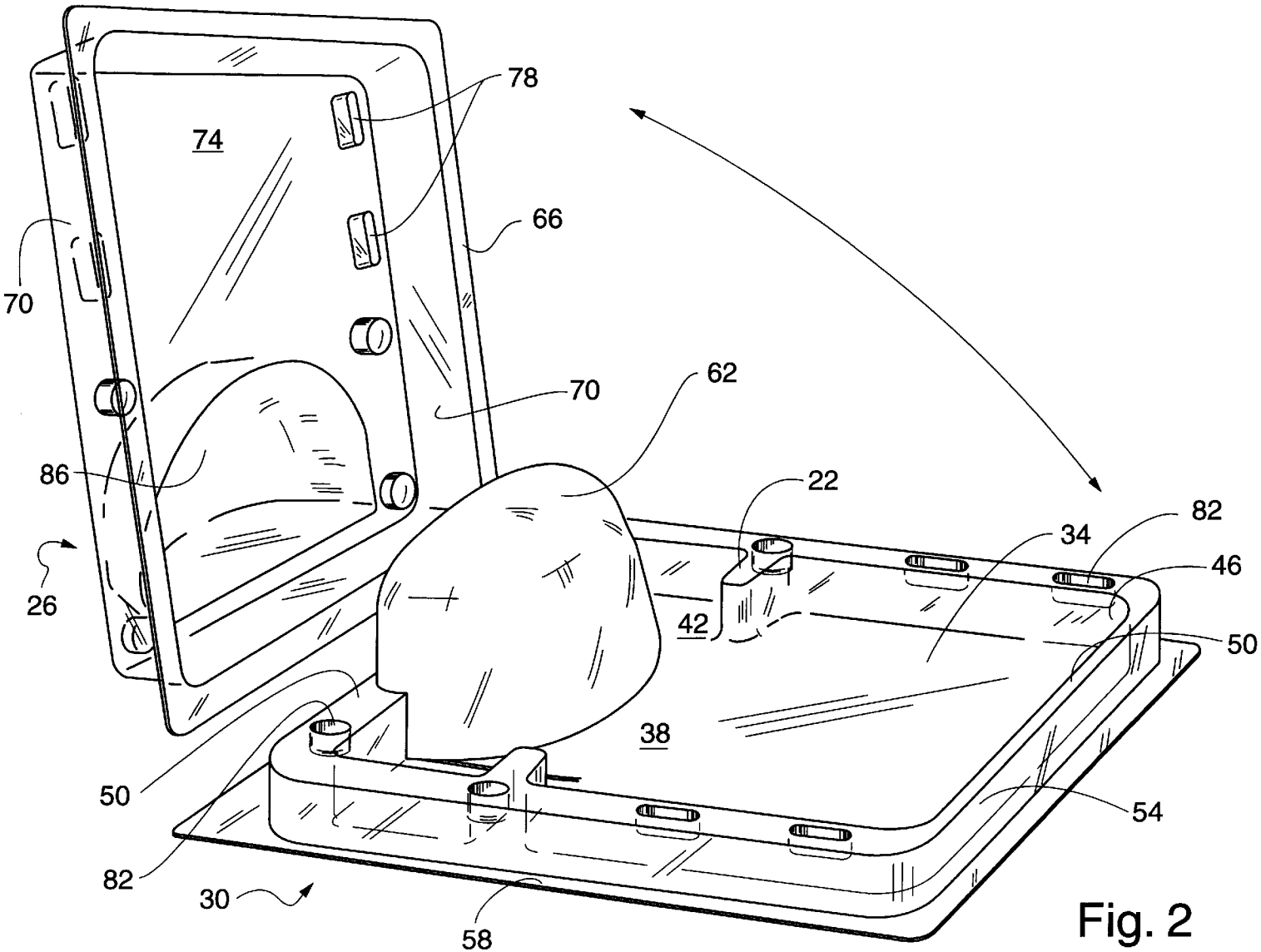
FIG. 2 shows the internal structure of the top and bottom of the package 10.

FIG. 1 illustrates the novel packaging combination of the present invention as it appears when displayed for retail purchase. In particular, the novel package combination 10 includes at least a hat retaining portion 14 and a garment retaining portion 18 wherein these two portions are at least partially separated by separators 22 as will be described in detail hereinbelow. In describing the novel aspects of the present invention further, reference is made to FIGS. 1, 2 and 3. Accordingly, the combination package 10 includes a top packaging cover 26 and a bottom packaging cover 30 (as best shown in FIG. 2), wherein when mated together or assembled as the package 10, provide the top and bottom, respectively, of both the hat retaining portion 14 and the garment retaining portion 18. The bottom packaging cover 30 includes a recessed central portion 34, wherein this central portion provides the package backing upon which the garment 36 and hat 40 (e.g. as shown in FIG. 1) substantially rest when the package 10 is in the upright position of FIG. 1. That is, it is intended that the garment 36 be placed in the garment retaining recess 38, and with the exception of possibly a portion of the bill or brim 44 of the hat 40, the hat resides substantially in the hat retaining recess 42 that is at least partially separated from the garment retaining recess 38 by the separators 22. However, it is also an aspect of the present invention that the bill or brim 44 of the hat may extend into the garment retaining recess 38 and, in one embodiment, is tucked underneath the garment 36 so that any decals or pictures residing on the garment may have as much visibility as is allowed. Further, note that the separators 22 extend between the garment retaining recess 38 and the hat retaining recess 42 sufficiently to keep the garment 36 within the garment retaining recess and additionally to facilitate maintaining the orientation of the hat 40 in the position shown in FIG. 1. That is, the brim 44 (FIG. 1) that extends into the garment retaining recess 38 extends substantially the entire opening between the two separators 22 so that the hat 40 does not inadvertently become misaligned within the package 10.

Note that the walls 46 surrounding the recessed central portion 34 are sufficiently high so that both the hat 40 and the garment 36 may be appealingly presented without wrinkles or harsh creases. Accordingly, in one embodiment, the inner walls 46 extend substantially normal to the recessed central portion 34 for approximately 1 inch although a range of ½ inch to 2 inches may be acceptable depending on the garment 36 (or other article of clothing (such as, e.g., a sweat garment, coat, or tunic), and the hat 40 provided within the package 10. At the top of the inner walls 46, a border 50 is provided that surrounds the recessed central portion 34. The border 50 is, in turn, integrally connected to the outer walls 54 that are in general substantially parallel to the inner walls 46 (with the exception of the portion of the inner walls 46 providing the contour for the separators 22). Finally, extending beyond the outer walls 54 is a flange 58 that extends around the perimeter of the bottom packaging cover 30. Thus, the inner walls 46, border 50, outer walls 54 and the flange 58 form a relatively rigid frame for the package 10 that assists in preventing creasing and folding of the package.

Additionally, the bottom packaging cover 30 includes a protruding hat support area 62 upon which the head encompassing portion of the hat 40 can be supported in a manner similar to how the hat would be supported when worn by a user. More particularly, when the hat 40 is a substantially conventional cap with a brim 44 (e.g., a baseball cap), the hat support area 62 conforms to an inner curvature of the cap so that when the back half of the cap is folded within the front portion, the hat support area 62 provides support for the cap so that the cap is displayed without wrinkling or distortion of the front half of the cap.

In one embodiment, the package top 26 has more than two portions having different package heights (where provided in the orientation of FIG. 2). For example, a plurality of varying package heights may be provided. Additionally, the package top 26 may be molded so that it not only facilitates holding the items in preferred orientations (e.g., slanted, standing upright, etc.), but also so that the package top also provides a design that is related to the items therein. For example, if the cap 40 and garment of FIG. 1 were related to golf, then a golf club could be molded into the package top.

Referring now to the structure of the top packaging cover 26, this cover includes an outer flange 66 that surrounds the other portions of the top packaging cover, and this flange is integrally and seamlessly connected to walls 70 that surround a top raised portion 74. Note that the walls 70 and the flange 66 mate with the outer walls 54 and flange 58 of the bottom packaging cover when the package 10 is assembled. That is, when assembled, the walls 70 and the outer walls 54 become adjacent to one another and the flange 66 and the flange 58 become adjacent to one another. Additionally, to facilitate the aligning and securing of the top packaging cover 26 onto the bottom packaging cover 30, mating alignment recesses and tabs are provided between the border 50 and the raised portion 74 that becomes adjacent to the border when the package 10 is assembled. More particularly, spaced about the periphery of the raised portion 74 are tabs 78 that are integral with the raised portion 74 and that project inwardly toward the border 50 when the package 10 is assembled. Corresponding to each of the tabs 78 is a mating indentation 82 residing on the border 50.

Figure 3:
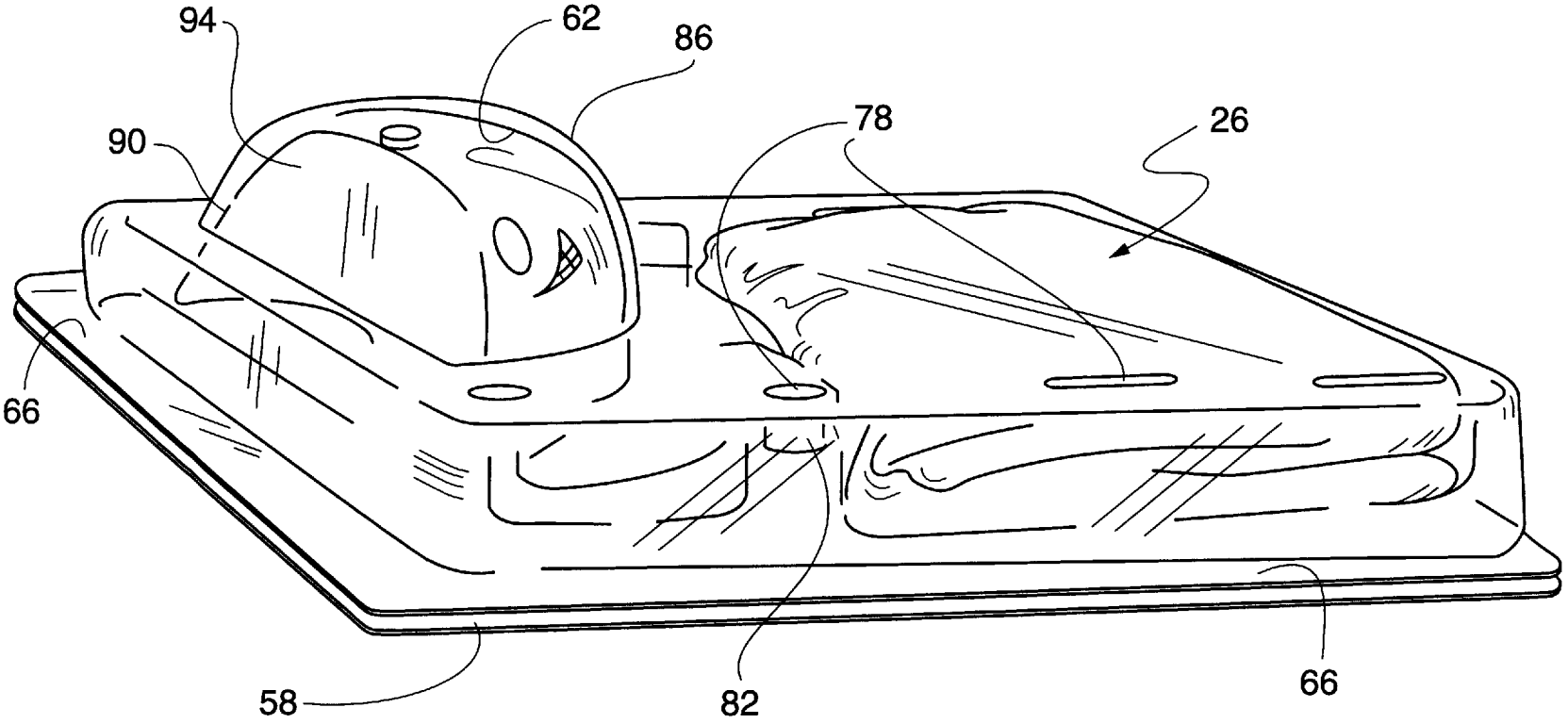
FIG. 3 shows another perspective view of the package, wherein the mating contours of the top and bottom of the package are illustrated.

Additionally, the top packaging cover 26 includes a hat covering area 86 that substantially conforms to at least a portion of the hat as it would appear on a wearer's head. For example, when the hat 40 is a cap as in FIG. 1, the top packaging cover 26 substantially conforms to the exterior front half of the cap. Further, the hat covering area 86 includes an enclosed backing 90 that becomes adjacent to a corresponding enclosed backing 94 of the hat support area 62 (FIG. 3). Thus, the two enclosed backings 90 and 94 further assist in making the package 10 less prone to creasing and/or denting which would at least distort the presentation of the hat 40 and garment 36 there within.

In at least one embodiment of the present invention, each of the top packaging cover 26 and the bottom packaging cover 30 are separately molded from plastic or other moldable material of sufficient thickness or gauge to ensure the integrity of the package 10 (e.g., for a typical packaging plastic a gauge within the range of 0.02 mls +/−10%). Moreover, note that the configuration of the top packaging cover 26 is such that a plurality of such covers may be stacked with corresponding portions and contours adjacent to one another in the stack, and a similar statement is true for stacking a plurality of bottom packaging covers 30. Moreover, in another embodiment, instead of separately forming the top packaging covers 26 and the bottom packaging covers 30, corresponding or mating top and bottom packaging covers 26 and 30 may be molded simultaneously and connected together via the flanges 58 and 66 so as to effectively form a plastic hinge between the top packaging cover and the bottom packaging cover.

In another embodiment of the present invention, other retaining portions may be provided by the package 10 of the present invention. For example, the areas adjacent to the hat within the hat retaining portion 14 (i.e., free areas 98) may be used for containing items such as key chains, gloves, socks, and/or sports-related items such as golf tees, wristbands, etc. Note that in providing such additional items within the package 10, further separators such as separators 22 may be required around the hat 40. Similarly, the garment retaining portion 18 may be also subdivided so that, for example, additional clothing items may be retained therein (e.g., a tie, jewelry, a scarf, etc.).

Various other embodiments of the package 10 are also within the scope of the present invention. For example, the mating hat support area 62 and the hat cover area 86 may be modified somewhat so that a visor instead of a hat is secured in the hat retaining portion 14. Moreover, the present invention is also particularly useful in packaging hats and garments together wherein the hat has an unconventional shape and/or has appendages thereon. For example, the present packaging may be particularly useful for hats or caps with wings, horns, ears, propeller blades, etc., since such added features can be prone to soiling and/or deforming easily when not encased within packaging such as the present invention offers.

In another embodiment of the present invention, the space between the inner walls 46, and the hat 40 and garment 36 may be hidden by a planar sheet of filler material (e.g., paper or cardboard) surrounding the hat and garment. Accordingly, such filler material may provide additional advertising or highlighting of the hat 40 and garment 36 so that there is greater incentive for a consumer to purchase the combination hat and garment provided by the packaging of the present invention.

When securing the packaging 10 about the hat 40 and garment 36 enclosed therein, the present invention offers various ways to secure the top packaging cover 26 to the bottom packaging cover 30. For example, when these two packaging covers are mated together, the flanges 58 and 66 can be glued, stapled and/or heat sealed together. Alternatively, other mating portions may be glued, stapled and/or heat sealed; e.g., the mating walls 70 and 54, and/or the border 50 and the adjacent raised portion 74, and/or the tabs 78 and the indentations 82.

In one embodiment of the present invention, the raised portion 74 may include, or have attached to an envelope, a pouch or another means for securing a note or envelope. For example, such an envelope retaining means may be provided in an area roughly corresponding to where the brim 44 (FIG. 1) is located. Moreover, if such an envelope retaining means is accessible from outside the package 10 by, for example, a slot in the raised portion 74, then a purchaser of the items packaged according to the present invention may easily attach a personal card to the packaging 10 for giving the items enclosed therein as a gift.

The foregoing discussion of the invention has been presented for purposes of illustration and description. Further, the description is not intended to limit the invention to the form disclosed herein. Consequently, variation and modification commensurate with the above teachings, within the skill and knowledge of the relevant art, are within the scope of the present invention. The embodiment described hereinabove is further intended to explain the best mode presently known of practicing the invention and to enable others skilled in the art to utilize the invention as such, or in other embodiments, and with the various modifications required by their particular application or uses of the invention. It is intended that the appended claims be construed to include alternative embodiments to the extent permitted by the prior art.

What is claimed is:

1. A package for combining a hat and a garment, comprising:

a hat retaining portion having a contour for displaying at least a frontal portion of the hat with substantially a same contour as when worn by a user;

a garment retaining portion for displaying a garment; and a reinforcing means for reinforcing said package against bending a brim of the hat.

2. A package as claimed in claim 1, wherein said frontal portion of the hat is visible through said package.

3. A package as claimed in claim 2, wherein the hat is one of a cap and a visor with the brim being attached to the frontal portion.

4. A package as claimed in claim 1, wherein said hat retaining portion includes:

a first hat contoured portion having a first interior package contour conforming to the frontal portion of the hat;

a second hat contoured portion having a second interior package contour for substantially following a contour of said first interior package contour;

wherein at least the frontal portion of the hat is between said first interior package contour and said second interior package contour.

5. A package as claimed in claim 4, wherein said first hat contoured portion is substantially transparent.

6. A package as claimed in claim 4, wherein said first hat contoured portion is part of a top cover of said package, and said second hat contoured portion is part of a bottom cover of said package.

7. A package as claimed in claim 1, wherein said garment retaining portion includes a garment retaining recess that is substantially rectangular.

8. A package as claimed in claim 1, wherein said hat retaining portion and said garment retaining portion each have a portion of said package included in a top cover and a bottom cover of said package.

9. A package as claimed in claim 8, wherein each of said top cover and said bottom cover includes molded plastic.

10. A package as claimed in claim 8, wherein, when said package is assembled, said top cover and said bottom cover have, substantially surrounding said hat retaining portion and said garment retaining portion, at least one of:

(a) corresponding adjacent flanges;

(b) corresponding adjacent walls; and (c) one or more mating tabs and indentations.

11. A package as claimed in claim 10, wherein said top cover and said bottom cover are affixed together at one of said adjacent flanges, said adjacent walls, and said one or more mating tabs and indentations.

12. A package as claimed in claim 11, wherein said top cover and said bottom cover are affixed together using one of:

staples, glue and a heat sealing technique.

13. A package as claimed in claim 8, wherein said top cover and said bottom cover are manufactured as a single unit and are foldable together.

14. A package as claimed in claim 1, wherein said reinforcing means includes a separator means for separating said hat retaining portion from said garment retaining portion, wherein said retaining means also inhibits the brim of the hat from moving from a predetermined orientation.

15. A package as claimed in claim 14, wherein said separator means projects substantially orthogonally from a border of the package into a recessed central portion of said package.

16. A package as claimed in claim 15, wherein said border includes a raised portion of a bottom cover of the package, wherein said border substantially surrounds both said hat retaining portion and said garment retaining portion.

17. A package as claimed in claim 16, wherein said border includes one or more indentations that mate with tabs of a top cover of the package.

18. A package as claimed in claim 1, wherein said package further includes a retaining portion for one of:

gloves, socks and items related to a sport.

19. A method for packaging a hat and a garment, comprising:

placing the garment in a garment retaining recess of a bottom cover of a package;

positioning the hat between similarly contoured portions of a top cover and said bottom cover of the package, wherein said contoured portions substantially follow a contour of at least a portion of the hat as it would appear on a wearer's head;

affixing said top and bottom covers together for enclosing the hat and the garment.

20. A method as claimed in claim 19, wherein said step of positioning includes providing a brim of the hat between two package reinforcing separators projecting from a raised interior wall of said bottom cover toward a recessed central portion thereof.

21. A method as claimed in claim 20, wherein said reinforcing separators inhibit said brim from dislocating from a predetermined location between said separators.

* * * * *